United States Patent [19]

Hollyday, III

[11] 4,198,716

[45] Apr. 22, 1980

[54] FEET SUPPORT ATTACHMENT FOR LAVATORIES

[76] Inventor: Hughlett Hollyday, III, 5028 Sunneyslope Ave., Sherman Oaks, Calif. 91423

[21] Appl. No.: 911,361

[22] Filed: Jun. 1, 1978

Related U.S. Application Data

[63] Continuation-in-part of Ser. No. 795,487, May 10, 1977, abandoned.

[51] Int. Cl.[2] ..... E03D 11/00; A47C 7/50; A47C 16/00

[52] U.S. Cl. ..... 4/254; 4/DIG. 5; 297/438

[58] Field of Search ..... 4/1, 134, 231, 254, 4/DIG. 5, 144.1, 685 AB; 297/423, 428, 438; D23/53, 69–71

[56] References Cited

U.S. PATENT DOCUMENTS

| | | | |
|---|---|---|---|
| 775,029 | 11/1904 | Dezendorf | 4/254 |
| 1,678,466 | 7/1928 | Gunckel | 4/254 |
| 1,682,799 | 9/1928 | Richards | 4/DIG. 5 |
| 1,752,499 | 4/1930 | Meath | 4/254 |
| 2,008,689 | 7/1935 | Donahoe | 4/254 |
| 2,122,832 | 7/1938 | Bentz | 4/254 |
| 2,954,566 | 10/1960 | Lottenberg | 4/254 |
| 4,137,573 | 2/1979 | Kroeger | 4/144.1 |

FOREIGN PATENT DOCUMENTS

| | | | |
|---|---|---|---|
| 292737 | 6/1928 | United Kingdom | 4/254 |
| 437982 | 11/1935 | United Kingdom | 4/254 |

*Primary Examiner*—Stuart S. Levy
*Attorney, Agent, or Firm*—Don B. Finkelstein

[57] ABSTRACT

Feet support arrangement for detachable mounting on the front lip of a bowl of a lavatory to support the feet of a person sitting upon the lavatory. The feet support generally has a vertically disposed body member with a hook means at the upper edge thereof. The hook means extends over the front portion of the rim of the bowl of the lavatory and has a dependent flange extending downwardly therefrom on the inside of the bowl with the body means extending downwardly on the outside of the bowl. The flange member functions as a splash guard to prevent the passage of liquid between the rim of the bowl and the seat. An upper surface of the hook means is provided with a sealing means to engage the lower surface of the seat when the seat is in the down position. A pair of oppositely disposed feet support means extend outwardly in opposite directions from side edges of the body means. A person sitting on the seat of the lavatory may rest each foot upon one of the foot rest means so that the angular position between the legs and the torso of the person assumes an acute angle and thereby lessens the pressure exerted on the interior tibia muscles. Additionally, children may rest their feet on the feet support means to provide an additional sense of security for those children whose legs are not long enough to reach the floor upon which the lavatory is mounted.

5 Claims, 2 Drawing Figures

FEET SUPPORT ATTACHMENT FOR LAVATORIES

REFERENCE TO RELATED APPLICATION

This is a continuation-in-part of my patent application Ser. No. 795,487 filed May 10, 1977; now abandoned, and the teaching and technology thereof are incorporated herein by reference.

BACKGROUND OF THE INVENTION

1. Field of the Invention

This invention relates to the lavatory art and more particularly to an improved detachably mountable feet support arrangement for use with the lavatory.

2. Background of the Invention

In the conventional lavatories the seat is usually disposed in a substantially horizontal plane. A person of normal height, sitting upon the lavatory rests his feet upon the ground and generally, during defecation, angles the body forwardly. However, the bodily position generally considered most advantageous during defecation is one in which the upper legs, that is the thighs, make a very acute angle with the torso. Such a position is generally uncomfortable and/or cannot be achieved in the conventional lavatory when the user's feet are resting upon the ground.

Additionally, it has been found that small children whose little legs are not long enough to reach to the ground, often have a sense of insecurity when sitting upon the lavatory and consequently a solid support for the feet of such small children can provide a much higher sense of security.

Since defecation is not the only function performed by people sitting upon the lavatory it is also desirable that such a foot rest arrangement be detachably mountable upon the lavatory. Additionally, such a detachably mountable feet support can be fabricated comparatively inexpensively and also maintained in a hygenic condition quite easily. Thus, such a feet support arrangement should preferably be fabricated of comparatively inexpensive materials, be detachably mountable upon the lavatory so that it may be utilized only when desired and, further, be comparatively easy to clean.

Further, it is also desired that the feet support arrangement provide a splash guard to prevent the passage of liquid in the region between the seat and the rim of the lavatory. This is particularly useful when small children are utilizing the device. Since most lavatories are provided with seats that are pivotally mounted with respect to the rim of the bowl of the lavatory in the seating or down position of the seat there are provided bumpers on the undersurface of the seat to engage the upper surface of the rim of the bowl and space the seat a preselected distance from the rim. The preferred feet support arrangement, therefore, has a sealing means such that the thickness of the feet support arrangement is approximately equal to the thickness of the bumpers on the lower surface of the seat and the sealing means engages the lower surface of the seat and thus prevents the passage of liquids out of the bowl in the space between the lower surface of the seat and the upper surface of the rim in front portions thereof.

Additionally, it is preferred that the feet support means of the feet support arrngement be spaced outwardly from the bowl of the lavatory in order that the height of the users knees may be raised relative to the buttocks to provide a more comfortable and medically approved position.

Prior art feet support arrangements have generally not provided the above desired objectives. For example, in British Pat. No. 292,737 there is shown a ladder type arrangement which does not directly couple to the bowl of the lavatory and does not provide any type of splash guard.

British Pat. No. 437,982 shows a type of feet support arrangement that may be coupled to the underside of the seat of the lavatory or, alternatively, to the front portion of the rim of the bowl of the lavatory but does not provide the desired splash guard, or other objectives above set forth.

SUMMARY OF THE INVENTION

Accordingly, it is an object of the present invention to provide an improved feet support arrangement for use with a lavatory.

It is another object of the present invention to provide improved feet support arrangement which may be detachably mountable upon a lavatory.

It is yet a further object of the present invention to provide an improved feet support arrangement that may be detachably mountable upon a lavatory and may be economically fabricated and easily maintained in a hygenic condition.

The above and other objects of the invention are achieved, in accordance with the preferred embodiment thereof by providing a body means extending substantially vertically. A hook means is mounted to the top edge of the body means and has an upper member extending substantially horizontally and a flange member spaced from the body means and extending substantially vertically. The hook means is adapted to fit over the front portion of the rim of the bowl of the lavatory. Preferably, the flange member and the upper portion of the body means are arcuate to approximate the shape of conventional bowls of lavatories. The vertically dependent flange member defines a splash guard to prevent the passage of liquid therethrough and the upper member of the hook means has a sealing means along the upper surface thereof for engaging the underside of the seat means of the lavatory when the seat is in the down position. The thickness of the upper member and the sealing means is at least equivalent to the predetermined separation provided by the bumpers on the underside of the seat means which normally engage the upper surface of the rim of the bowl. Thus, the sealing means and the flange together prevent the emission of liquid between the seat and the rim.

A pair of outwardly extending feet support means are coupled to the lower edge of the body means to provide a place upon which the user of the device may rest his feet during, for example, defacation. Additionally, the feet support means provides a convenient resting place for small children whose little legs are not capable of reaching the floor and thus provides children with a higher degree of comfort and safety while utilizing the toilet.

The particular dimensions of the preferred embodiment of the present invention are selected so that the pressure exerted during sitting upon a conventional toilet seat upon the interior tibia muscles is lessened and, preferably, so that the knees of the user are raised to a position higher than the buttocks. These two conditions, it has been determined, tend to minimize dysfunction associated with defacation in many people.

During defecation, a person sitting upon the lavatory may rest his feet upon the foot support portions of the body means thereby raising the knees of the person and thus forming a very acute angle between the thighs of the person and the torso. When the use of the feet support arrangement as herein described is also accompanied by the user leaning forward, it will be appreciated that virtually any acute angle may be conveniently and easily achieved. It has been found that providing such an acute angle aids in the process of defecation.

Additionally, small children whose comparatively little legs do not reach the floor when sitting upon a conventionally sized lavatory have experienced a sense of insecurity. By resting their feet upon the foot support portions of the feet support arrangement described herein, a more secure and balanced position by such children may be achieved.

In a preferred embodiment of the present invention the body means and the mounting means are comprised of a plastic coated metal. Such a plastic coated metal may be a steel rod coated with a polyvinyl chloride which allows the structure to be economically manufactured yet very easily maintained in a hygenic state.

BRIEF DESCRIPTION OF THE DRAWINGS

The above and other embodiments of the present invention may be more fully understood from the following detailed description taken together with the accompanying drawings wherein similar reference characters refer to similar elements throughout and in which.

DESCRIPTION OF THE PREFERRED EMBODIMENTS

Figure 1:
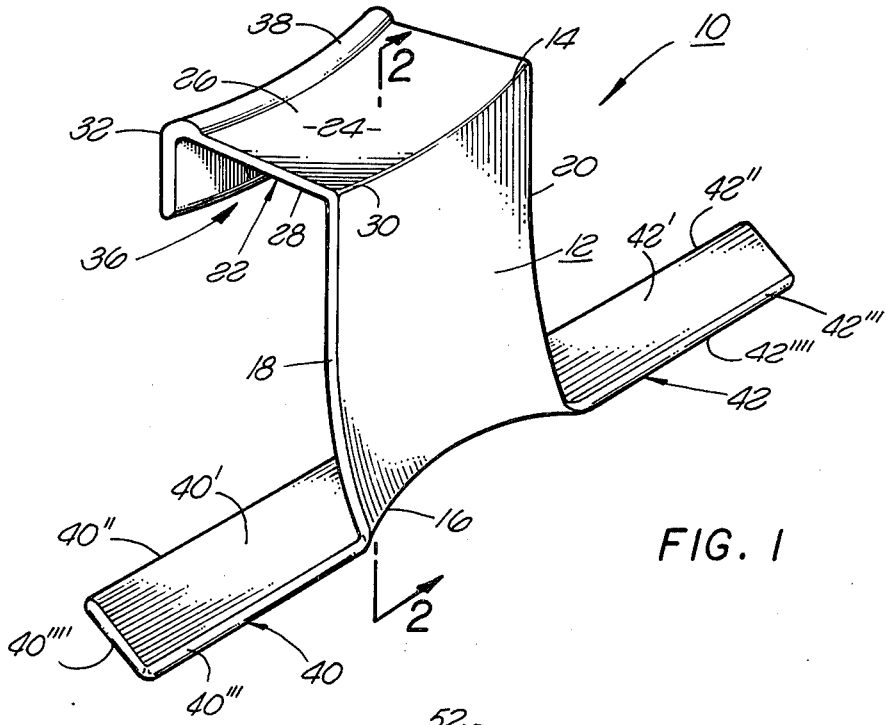
FIG. 1 is a perspective view of one embodiment of the present invention.
Figure 2:
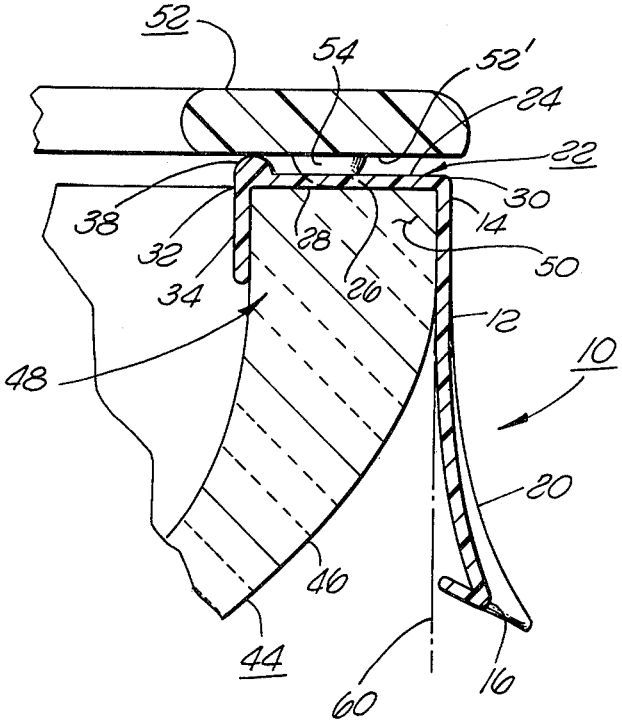
FIG. 2 is a sectional view taken along the line 2—2 of FIG. 1.

Referring now to the drawing, there is illustrated in FIGS. 1 and 2 one embodiment generally designated 10 of a preferred embodiment of the present invention of the feet support arrangement. As illustrated, there is provided a body member generally designated 12 having a top edge 14, an inwardly curved bottom edge 16 and a first preselected distance between the top edge 14 and lower edge 16. The body means 12 also has a pair of side edges 18 and 20 and a second preselected distance therebetween.

A hook means generally designated 22 is coupled to the upper edge 14 of the body means 12 and has an upper member 24 having an upper surface 26 and a lower surface 28. The upper member 24 also has an outer edge 30 and an inner edge 32. The outer edge 30 of the upper member 24 is coupled to the top edge 14 of the body means 12. A flange member 34 is coupled to the inner edge 32 of the upper member 24 and depends therefrom to define a rim receiving cavity 36 in the region between the flange member 34, the upper member 26 and the upper portions of the body means 12 in regions adjacent the top edge 14 thereof. The flange means 34, is described below in connection with FIG. 2, also acts as a splash guard to prevent the passage of liquids therethrough.

A sealing member 38 is coupled to the upper surface 26 of the upper member 24 regions adjacent the inner edge 32 thereof for purposes hereinafter set forth in connection with the description in FIG. 2.

A pair of feet support means 40 and 42 are coupled to the lower edge 16 of the body means 12 and extend outwardly from oppositely disposed side edges 18 and 20 thereof respectively.

Referring now to FIG. 2, there is illustrated the installation of the feet support arrangement 10 installed upon a conventional lavatory 44. The lavatory 44 is a type having a bowl 46 having a rim portion 48 with a front section 50 thereof. The lavatory 44 is also provided with a seat 52 which is pivotally mounted on the bowl 46 for movement from a seating, down position as shown in FIG. 2 to an up position. The lavatory including the bowl 46 and seat 52 are of conventional design and do not, per se, form part of the present invention. In such lavatories, the seat 52 is often provided with a bumper means 54 which provides a predetermined separation between the under surface 52′ of the seat means 52 and the rim 48 of the bowl 46 when the seat 52 is in the seating or down position.

The feet support arrangement 10 is adapted to be placed over the forward portion 50 of the rim 48 of bowl 46 and intermediate the seat 52 and the rim 48, as illustrated in FIG. 2. Thus, the combined thickness of the upper member 24 and sealing member 38 of the hook means 22 is at least as great as the predetermined separation provided by the bumper means 54 so that the upper surface of the sealing means 38 engages the lower surface 52′ of the seat means 52 to prevent the passage of liquid between the lower surface 52′ and the seat means 52 and the rim 48.

It has been found that it is preferable that the feet means 40 and 42 shown in FIG. 1 be spaced outwardly from a vertical plane, generally designated 60 in FIG. 2 containing the upper edge 14 of the body means 12 approximately one inch though the range may be between ½ inch and 2½ inches.

Further, preferably, the upper surface 40′ and 42′ of each of the feet support means 40 and 42 are preferably inclined at a predetermined angle, on the order of 15 to 30 degrees from the horizontal in order to provide the desired relationship between the feet, knees and buttocks of the user. This angle is generally such that the rear surface 40″ and 42″ slope downwardly and outwardly toward the front surface 40‴ and 42‴ respectively. The lower surface 40⁗ and 42⁗ may, if desired, also follow the same sloping path as the upper surface 40′ and 42′ respectively.

It has been found that the upper edge 40 of the body means 12 and the outer edge 30 of the upper member 26 of hook means 22 as well as the inner edge 32 thereof be curved as illustrated in FIG. 1 in order to accommodate the conventional configuration of lavatories.

In the unit fabricated in accordance with the principals of the present invention the first preselected distance between the upper edge 14 and lower edge 16 of the body means 12 is on the order of seven inches, the flange member 34 is spaced approximately two inches from the body means 12, the width between the side edges 18 and 20 of the body means 12 is on the order of five inches, the thickness between the upper surface 26 and lower surface 28 of the upper member 24 of hook means 22 is on the order of ⅛ to ⅜ inches and the thickness of the seal means 32 is on the order of 3/16 to ⅜ of an inch. With the above dimensions, it has been found that the seating arrangement 10 provides the benefit described above.

It has further been found that by fabrication of the feet support arrangement 10 in a unitary configuration such structure may not only be economically fabricated but also maintained quite easily in a hygienic condition. The materials utilized may be metal, plastic, plastic coated metal, or any desired material satisfactory for the purposes intended.

From the above, it is apparent that there has been provided an improved feet support arrangement which may be readily utilized on conventional lavatories and may be quite economically fabricated. Additionally, the structure described may be quite easily maintained in a highly hygenic condition.

Those skilled in the art may find many variations and adaptations of the present invention and all such variations and adaptations falling within the true scope and spirit of the present invention are intended to be covered by the appended claims. It will be appreciated that the embodiments set forth herein represent the preferred embodiments of the present invention and are not limiting upon the invention.

I claim:

1. An improved unitarily fabricated feet support arrangement for a lavatory for utilization by a person sitting thereon, the lavatory of the type having a bowl with an upper rim, and said upper rim having a front lip, a seat means on which the person sits and said seat means pivotally mounted on the lavatory and movable from a seating, down position adjacent the rim to an up position spaced from at least the front portion of the rim, and said seat means having a pair of spaced apart bumper means on the lower surface thereof engaging said rim means to separate said seat means a predetermined separation from the rim means for the condition of said seat means in said down position, comprising, in combination:

a body means having an outwardly curved top edge, an outwardly curved bottom edge spaced a first preselected distance from said top edge, a pair of side edges extending between said top edge and said bottom edge and spaced a second preselected distance apart and said second predetermined distance less than the spacing between said spaced apart bumper means on said seat means;

a hook means coupled to said top edge of said body means and having:

an upper member having an upper surface and a lower surface and a first predetermined thickness therebetween and extending substantially at right angles to said body means and having a width substantially equal to said second preselected distance between said side edges of said body means, and said upper member having an outwardly curved outer edge coupled to said top edge of said body means and an outwardly curved inner edge spaced an outwardly curved third preselected distance from said outer edge and said upper member positionable intermediate said upper rim of said bowl of said lavatory and said seat means thereof for said seat means in said down position thereof;

a flange member coupled to said inner edge of said upper member and depending therefrom to define a rim receiving cavity between regions of said body means adjacent said top edge thereof, said upper member and said flange member, and said flange member extending continuously substantially said second predetermined distance defining a splash guard for preventing the passing of liquid therethrough, and said hook means engageable with said front portion of said rim of said lavatory whereby said body means depends downwardly from said rim on the outside thereof and said flange member of said hook means extends downwardly from said rim on the inside thereof;

a seal means extending continuously substantially said second predetermined distance having a second predetermined thickness coupled to said upper surface of said upper member of said hook means in regions adjacent said inner edge thereof and extending substantially said second predetermined distance for engaging the lower surface of said seat means of said lavatory for said seat means in the seating, down position thereof, and the combined thickness of said first predetermined thickness of said upper member and said second predetermined thickness of said sealing means substantially equal to said predetermined separation between said rim means and said seat means;

a pair of feet support means coupled to said body means adjacent said inwardly curved bottom edge thereof and a first of said pair of feet support means extending horizontally outwardly in a first direction from a first of said pair of side edges of said body means, and the second of said pair of feet support means extending horizontally outwardly from the second of said pair of side edges of said body means in a second direction opposite said first direction; and each of said foot support means comprises a bar-like extension having an upper surface, a lower surface, a front surface, and a rear surface, and said upper surface of each of said feet support means is positioned at a predetermined angle to slope downwardly from said rear surface thereof toward said front surface thereof.

2. The arrangement defined in claim 1 wherein:

said lower edge of said body means is spaced outwardly from a vertical plane containing said top edge of said body means a fourth preselected distance.

3. The arrangement defined in claim 2 wherein:

said first preselected distance is on the order of seven inches;

said second preselected distance is on the order of five inches;

said third preselected distance is on the order of three inches;

said fourth preselected distance is on the order of one inch; and said first preselected thickness is on the order of 5/16 of an inch.

4. The arrangement defined in claim 3 wherein:

said second preselected thickness is on the order of 3/16 of an inch; and said predetermined separation is on the order of ½ of an inch.

5. The arrangement defined in claim 4 wherein:

said upper portions of said body means adjacent said top edge thereof are arcuate.

* * * * *